United States Patent [19]

Huspeni

[11] 4,432,109

[45] Feb. 21, 1984

[54] PLASTIC SUPPORT PLATFORM FOR MATTRESS STRUCTURE

[75] Inventor: Paul J. Huspeni, Minneapolis, Minn.

[73] Assignee: Conwed Corporation, St. Paul, Minn.

[21] Appl. No.: 342,216

[22] Filed: Jan. 25, 1982

[51] Int. Cl.[3] ..... A47C 23/32

[52] U.S. Cl. ..... 5/478; 264/167; 264/DIG. 81; 428/107; 428/108; 428/213; 428/255; 428/910

[58] Field of Search ..... 5/478, 479, 475; 428/213, 107, 108, 255, 910; 264/DIG. 81, 167

[56] References Cited

U.S. PATENT DOCUMENTS

| | | | |
|---|---|---|---|
| 3,070,814 | 1/1963 | Withoff | 5/478 |
| 3,252,181 | 5/1966 | Hureau | 5/478 |
| 3,315,283 | 4/1967 | Larsen | 5/478 |
| 3,562,825 | 2/1971 | Larsen | 5/478 |
| 3,576,040 | 4/1971 | Larsen | 5/478 |
| 3,579,774 | 5/1971 | Shreve | 55/478 |
| 3,923,293 | 12/1975 | Wiegand | 5/478 |

*Primary Examiner*—Alexander Grosz

*Attorney, Agent, or Firm*—Eyre, Mann, Lucas & Just

[57] ABSTRACT

A mattress comprising a plurality of spaced springs, a plastic support platform having a plurality of extruded unoriented plastic spaced longitudinal support members and a plurality of extruded unoriented plastic spaced longitudinal stabilizing members, at least one of said stabilizing members being in position in each space between said longitudinal support members, said stabilizing members being smaller than said support members, a plurality of extruded plastic spaced cross-stabilizing members that intersect said support and stabilizing members substantially at a right angle and are integrally joined at the crossings, said cross-stabilizing members being oriented and smaller than said longitudinal support members, said support platform being in position on top of said springs with said longitudinal support members extending along the length of the mattress in contact with a majority of plurality of springs, said longitudinal members having a breaking load of at least about 35 pounds for a strip having one large longitudinal member and one small longitudinal stabilizing member and said cross-stabilizing members having a breaking load of at least about 75 pounds for a strip having twelve said cross-stabilizing members and cushioning material positioned on top of said plastic support platform.

11 Claims, 6 Drawing Figures

PLASTIC SUPPORT PLATFORM FOR MATTRESS STRUCTURE

The present invention is directed to spring cushioning structures and to a plastic support platform as a component thereof.

BACKGROUND OF THE INVENTION

In conventional mattress structures, cushioning material such as a cotton batt is supported on a spring wire foundation comprising a plurality of spaced springs usually coil or sinuous springs tied together and generally arranged in substantially parallel rows along the length and width of the mattress. A cotton scrim may be sewed to the cushioning material for ease of handling.

In order to prevent "dimpling" and give more uniform support, a spring-bridging unit is applied between the cushioning material and spring wire foundation. The spring-bridging unit may be an open network of wire and rope or leno-weave cotton thread or burlap reinforced with wire strands. More recently, extruded plastic net has been employed as the spring-bridging unit.

U.S. Pat. No. 3,315,283 teaches the use of extruded plastic square mesh net which is heated and stretched to orient the plastic strands which thereby become stronger and stretch resistant. The oriented plastic net may be attached with a suitable adhesive to the mattress cushioning material as the spring-bridging unit for the spring wire foundation.

U.S. Pat. No. 3,562,825 discloses a mattress spring-bridging unit of extruded plastic square mesh net in which the longitudinal strands are thicker than the transverse strands that run across the width of the mattress. The relatively thick strands have a diameter of 0.066 inch and are arranged on 1½ inch centers while the thinner strands have a diameter of 0.016 inch and are arranged on ¼ inch centers. The thicker strands are not as highly oriented as the thinner strands.

U.S. Pat. No. 3,070,814 discloses the use of adhesive for securing the spring-bridging unit of U.S. Pat. No. 3,315,283 to the spring wire foundation.

U.S. Pat. No. 3,576,040 is directed to a spring-bridging unit of extruded plastic square mesh net using an adhesive plastic which may be directly bonded to the metal of the spring wire foundation. The longitudinal strands are thicker than the transverse strands. The longitudinal strands are arranged on ¾ inch centers while the transverse strands are on ¼ inch centers. The strands in the net are not oriented.

U.S. Pat. No. 3,579,774 discloses an extruded plastic square mesh net in which both sets of strands are oriented and the net is stitched to the cushioning material to form a spring-bridging unit. The strand size and spacing are the same as in U.S. Pat. No. 3,562,825.

THE INVENTION

While the foregoing extruded plastic square mesh nets are widely used as spring-bridging units to replace burlap and wire and rope net, the extruded plastic nets of the prior art do not have the dimensional stability or structural rigidity required to provide the stiffness and uniform distribution of weight obtained with stiff metal "band liners". Firm or relatively hard mattresses include stiff metal "band liners" about one-quarter inch wide and one-sixteenth inch thick which run the length of the spring wire foundation and are attached at their ends of the stiff wire border of the mattress structure.

In accordance with the present invention, an extruded plastic square mesh support platform is provided with the dimensional stability and structural rigidity required for the stiffness and uniform distribution of weight that is obtained with stiff metal "band liners". The plastic square mesh support platform of the present invention is extruded with a plurality of spaced relatively large and heavy longitudinal support members having a plurality of spaced smaller and lighter longitudinal stabilizing members in the space between the relatively heavy members. The longitudinal support members are united in the platform structure by relatively small and light transverse cross-stabilizing members. The plastic of the cross-stabilizing members is fully oriented but the plastic in the longitudinal members remains in its extruded unoriented state.

For best results, the relatively heavy unoriented longitudinal support members are spaced to lie on top and preferably bisect a majority of the springs in the mattress spring wire foundation. These relatively heavy support members provide a stiff backbone for the support platform. The smaller longitudinal members in the spaces between the relatively heavy members stabilize the structure and in conjunction with the relatively small cross-stabilizing members, dimensional stability and added stiffness are achieved and the plastic support platform quite unexpectedly provided support comparable to that of stiff metal "band liners". It is believed that the oriented cross-stabilizing members in conjunction with the smaller unoriented longitudinal stabilizing members also preserve the integrity of the configuration of the structure in which the longitudinal members are integrally joined and cross the transverse cross-stabilizing members substantially at a right angle. This is a feature required to preserve the necessary stiffness and structural rigidity for a firm mattress structure.

Spring wire foundation mattresses provided with the extruded plastic support platform of the present invention passed the well-known "Cornell" and "Rocker" tests and proved to be a satisfactory replacement for the stiff metal "band liners". Replacement of the metal "band liners" by the extruded plastic support platform materially reduces the cost of manufacture and there is no need for the conventional spring-bridging unit which may also be eliminated.

These and further advantages and details of the present invention may be best understood by reference to the description of the drawings which illustrate one preferred form of mattress structure and in which.

Figure 2:
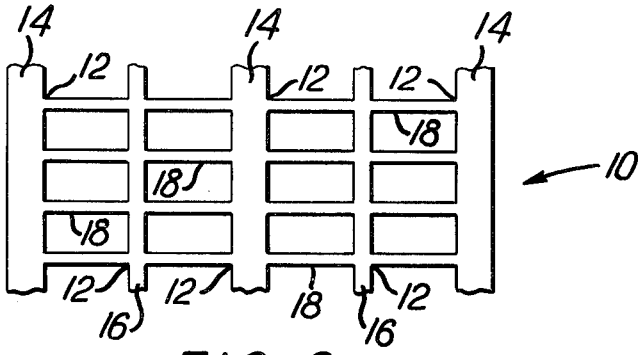
FIGS. 2 and 3 illustrate the extruded plastic support platform.
Figure 3:
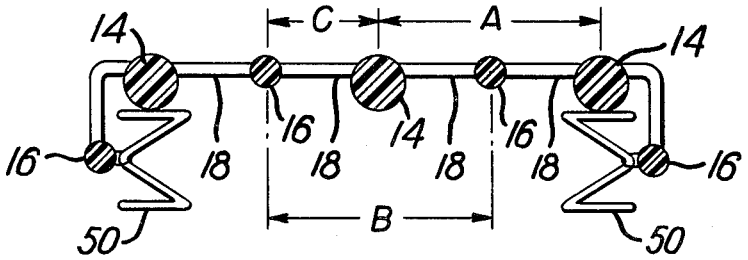

Referring now to FIGS. 2 and 3, the plastic support platform 10 is preferably extruded most conveniently by the method and apparatus disclosed in U.S. Pat. No.

3,252,181 whereby continuous longitudinal members are extruded through spaced grooved orifices in an outer circular stationary die. The stationary die mates with an interior circular die that is periodically lifted to separate the dies and extrude a circular cross-member integral with the member extruded by the stationary die. The members are extruded in the form of a net tube which is cut lengthwise to form a flat sheet.

The members extruded by the grooved orifices of the stationary die are extruded down in 'so-called' machine direction (MD) in a circle and the size of the MD members is readily varied by changing the size of the individual orifices. The members extruded by the interior circular die are characterized as transverse direction (TD) members and the space and size of the TD members may be varied by changing the time during which the two dies are separated.

The plastic support platform 10 may also be extruded with the method and apparatus disclosed in U.S. Pat. Nos. 2,919,467 and 3,051,987. In this case, two mating circular die members are rotated in counter directions. The mating surface of each die member is provided with spaced grooved orifices through which the plastic members are continuously extruded. When the grooved orifice in each die member is aligned the members cross to form an integral joint. The members are extruded as a tube having a diamond mesh which when cut along a helical line as described in U.S. Pat. No. 3,557,268 opens to a flat sheet with square mesh. Size of the members is readily varied by changing the size of the grooved orifices.

Other processes and apparatus are known for extruding plastic net-like structures with integral joints which may be formed by welding the two members together subsequent to extrusion. Polypropylene plastic material is preferred for best results in accordance with the present invention but other plastics may be used such as high density polyethylene.

It is important for maximum strength and stiffness to have integral joints 12 where the members cross in the extruded plastic support platform 10 and to have each member cross substantially at a right angle at the joint. The plastic support platform 10 is extruded with heavy support members 14 which may have a width of about 0.127 inch and thickness of about 0.124 inch. Thinner stabilizing members 16 are extruded between each heavy support member. The members 16 may have a width of about 0.061 inch and thickness of about 0.058 inch. The distance between extruded members 14 from center to center may be about 0.83 inch and the distance between the thinner stabilizing members 16 may be about the same. The cross stabilizing members 18 may be extruded to a width of about 0.048 and thickness of about 0.050 inch. The distance between extruded members 18 from center to center of adjacent members may be about 0.25 inch. The extruded structure may weigh about 104 pounds per 1,000 square feet.

The members may be extruded in either machine or transverse direction but it is of advantage to extrude members 14 and 16 in machine direction when employing the method and apparatus of U.S. Pat. No. 3,252,181 in order to obtain unlimited length since these members will extend along the length of the mattress structure.

Figure 5:
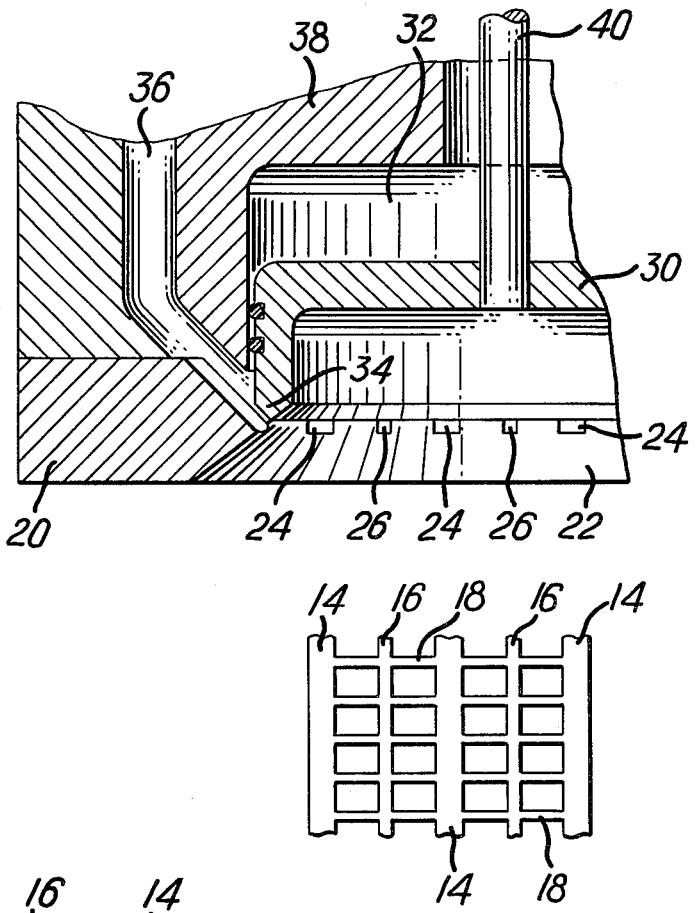
FIG. 5 illustrates one-half of a preferred form of extrusion die head partly in section to better illustrate the parts.

A preferred form of extrusion die head for extruding the plastic support platform 10 of the present invention in accordance with the teaching of U.S. Pat. No. 3,252,181 is illustrated in FIG. 5. The die head comprises an outer annular stationary die member 20 having a circular interior opening 22 therein. A plurality of spaced individual open groove orifices 24 for extruding heavy support members 14 are positioned in die member 20. In between each adjacent orifice 24 are a plurality of smaller groove orifices 26 for extruding the thinner stabilizing members 16. A reciprocating piston 30 preferably without any orifices therein is nested in the opening 32 and the smooth surface at the nose of piston 30 forms a seal with the lands of the grooved orifices 24 and 26 as at 34 when the piston is in its lowermost position as shown. The orifice grooves 24 and 26 remain open at all times to continuously extrude the members 14 and 16 downwardly in machine direction and in a circle. Polypropylene molten plastic is continuously supplied in known manner to orifices 24 and 26 by means of the annual feed channel 36. Piston 30 is in a sliding and sealing engagement with the inner wall of the stationary annular mandrel 38 and the outer annular surface of mandrel 38 forms the inner annular wall of the plastic feed channel 36. Piston 30 is attached in fixed position to a guide rod 40 which causes the piston to reciprocate up and down and into and out of engagement with the lands of the stationary die member 20. Each time the piston is lifted out of engagement with the stationary die member 20, an annular slit orifice defined by the distance between the lands of orifices 24 and 26 and the nose of piston 30 periodically extrudes an annular transverse cross-stabilizing member 18 integral with members 14 and 16 to form joints 12 where the members cross substantially at a right angle.

The resulting tube is drawn downwardly away from the extrusion die head over a cylindrical mandrel and through a water bath (not shown) to set the plastic material. The tube is slit longitudinally and opened into a flat sheet which may be accumulated on a wind up roll (not shown).

Figure 6:
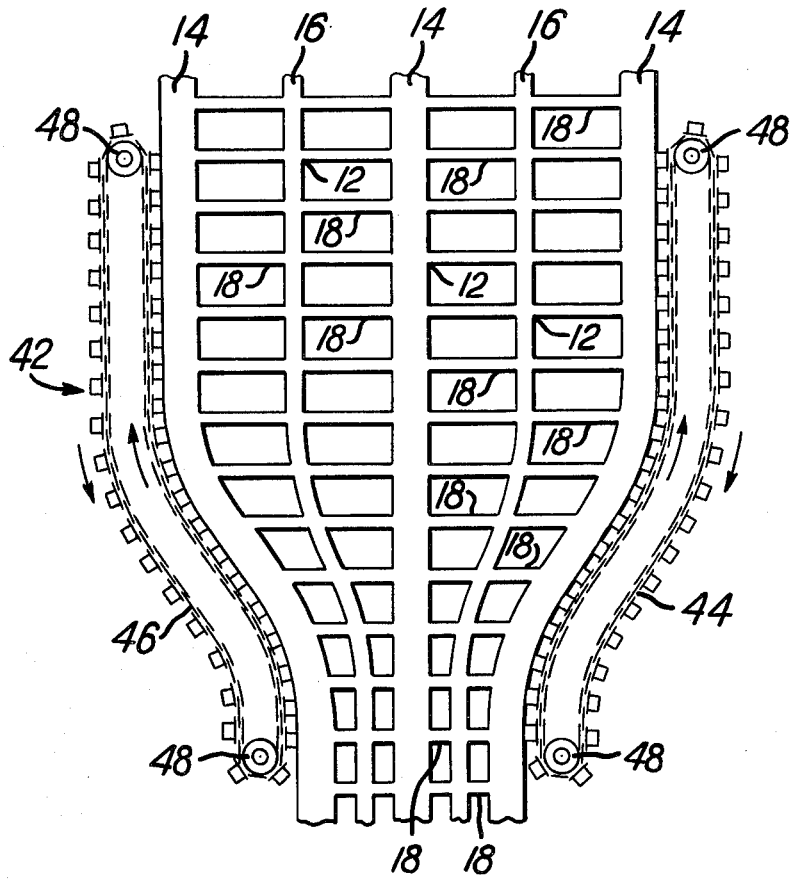
FIG. 6 is a diagrammatic illustration in top plan view of preferred apparatus for stretching the cross-stabilizing members of the plastic support platform.

The polypropylene flat sheet is thereafter subjected to orientation. A preferred form of tentering apparatus for orienting the cross-stabilizing members 18 is illustrated in FIG. 6. The extruded flat sheet is fed from a wind up roll (not shown) or otherwise into the tentering apparatus 42. The tentering apparatus comprises two spaced horizontally-disposed endless chain members 44 and 46 provided with conventional grippers (not shown) which grip opposite edges of the flat sheet in order to stretch members 18 traversely. The endless chains 44 and 46 are suitably driven in the direction of the arrows in FIG. 6 in conventional manner over a plurality of idler rolls 48 (two shown). The chains 44 and 46 initially travel along two parallel straight paths and then along diverging paths and finally along straight parallel paths. The polypropylene flat plastic sheet is preferably heated by an oven (not shown) on which the chains run in order to expedite stretching of the cross-stabilizing members 18 in the area where the chains diverge. The temperature employed for stretching the polypropylene members 18 is in the range from about 250° F. to about 325° F.

During passage through the divergent paths of chains 44 and 46 the members 18 are stretched and elongated in length to about five times their original traverse length. At the same time the longitudinal members 14 and 16 retain their original length but the space between members 14 and 16 is increased by the amount of elongation of members 18. The transverse oriented plastic support platform 10 is cooled by blowing of atmospheric air in the area where the chains again follow straight parallel paths and the plastic support platform 10 is taken up on a wind up roll (not shown) of any desired length.

In the foregoing example, the extruded polypropylene structure comprised heavy MD support members 14 of about 0.127 inch in width and about 0.124 thickness. The thinner stabilizing members 16 were about 0.061 inch wide and about 0.058 inch thick. The distance between adjacent members 16 from center to center was about 0.83 inch. The cross-stabilizing members 18 were 0.048 inch wide and about 0.050 inch wide. The distance between adjacent members 18 from center to center was about 0.25. The extruded polypropylene product weighed about 104 pounds per 1000 square feet.

The transversely oriented polypropylene support platform shown in FIGS. 2 and 3 comprises heavy support members 14 and thinner stabilizing members 16 of the same width and thickness as set forth above for the extruded structure. But the distance "A" (FIG. 3) from center to center of adjacent members 14 was about 4.0 inches and the distance "B" between adjacent members 16 from center to center was about 4.0 inches. In the preferred structure shown, the members are spaced an equal distance apart and the distance "C" from center to center was about 2 inches. The oriented cross stabilizing members 18 were about 0.022 inch wide and about 0.018 inch thick. The distance between adjacent members 18 from center to center was about 0.25 inch. The transversely oriented support platform weighed about 21.5 pounds per 1000 square feet.

It will be understood that the foregoing detailed specifications for the structure of the polypropylene support platform merely illustrate one preferred embodiment. The plastic, width, thickness and spacing of the members may be changed as is obvious to those skill in the art provided that the support platform includes large longitudinal support members and smaller longitudinal stabilizing members and small cross-stabilizing members and provided that the breaking load of the members satisfy certain minimum requirements.

The minimum breaking load of the longitudinal members is determined by cutting a test strip from platform 10 that has one large longitudinal member 14 and one small longitudinal stabilizing member 16. Both of the longitudinal members in the test strip are gripped at opposite ends by a pair of jaws spaced three inches apart and the jaws are thereafter separated at a constant speed of twelve inches per minute until one of the members 14 or 16 breaks. The force in pounds required to separate the jaws at the point of break is the breaking load which desirably should be at least about 35 pounds and preferably between about 37 to 54 pounds when the polymer is polypropylene.

The minimum breaking load for the cross-stabilizing members is determined on a test strip that has twelve members 18 all of which are gripped at opposite ends lengthwise by the above jaws and tested for breaking load as set forth above. The breaking load at the point where one of the twelve members 18 break desirably should be at least about 75 pounds and preferably between about 80 to 110 pounds when the polymer is polypropylene. Breaking loads above those set forth above may be used but this is not necessary and is just a waste of plastic material with increased cost. In the foregoing example the breaking load of the longitudinal members in platform 10 was about 39 pounds and the breaking load of the cross-stabilizing members was about 90 pounds.

As used in the specification and claims, the term "breaking load" is intended to mean the pounds at which one of the longitudinal members 14 or 16 break when a three inch wide test sample which includes at least one large member 14 and one smaller member 16 is tested for breaking load by separation of the pair of jaws as described above and the pounds at which one of the cross-stabilizing members break when a three inch wide test sample including at least twelve strands is subjected to the same test procedure.

Figure 1:
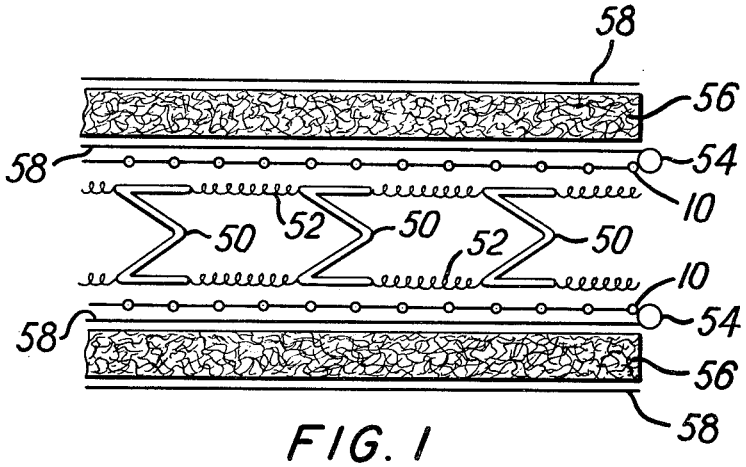
FIG. 1 illustrates a cross-section of a portion of a mattress utilizing the extruded plastic support platform of the present invention.
Figure 4:
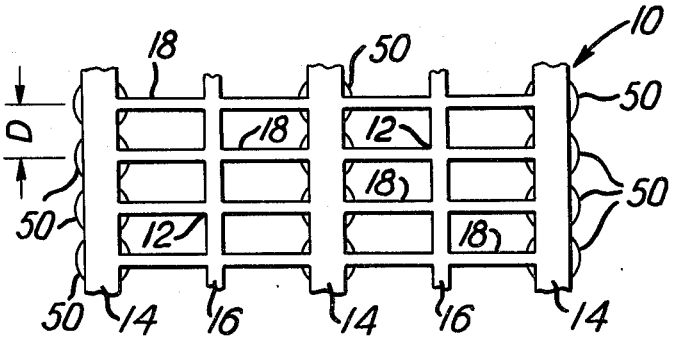
FIG. 4 illustrates one way in which the extruded plastic support platform is positioned on the springs in a mattress structure.

Other important features of the plastic support platform of the present invention are best understood by description of the mattress structure illustrated in FIGS. 1 and 4. Turning now to FIG. 1, the basic mattress structure (except for the plastic support platform 10) is conventional and well-known in the art. The mattress structure comprises a plurality of main springs such as coil springs 50 which are spaced and arranged preferably in parallel rows along the length and width of the mattress. The coil springs are secured in the structure by conventional ties such as the long thin coil springs 52 which are wound across the outer turns of the main springs and attached at their ends in conventional manner as by hog rings to the usual wire border 54 of the mattress. Cushioning material such as a cotton batt 56 is positioned over the springs and usually on both sides of the coil springs. The cushioning material usually has conventional cotton scrim 58 on one or both sides thereof.

As best shown in FIG. 4, the polypropylene support platform 10 is positioned under the cushioning material directly on the coil springs 50 with the heavy unoriented support members 14 running along the length of the mattress structure in position over the coil springs and for best results the unoriented support members 14 are positioned in the center of each of the coil springs as shown. The thinner unoriented stabilizing members 16 are generally in position in the space between adjacent springs 50 as shown but they may also be positioned over the coil springs in those cases where the coil springs are not arranged in precise parallel rows. The thinnest oriented cross-stabilizing members 18 may be in position on top of the main springs 50 as shown or the members 18 may be in the space between the coil springs depending on the particular spacing of the coil springs. In this connection, it will be understood that the coil springs 50 will vary in size and spacing and that face presented by the main springs will have relatively large open spaces with a multiplicity of relatively small wires in the face of the spring assembly. In all cases, however, it is important that the heavy support members 14 are in position on top of at least a majority of the main springs and the stabilizing members 16 and 18 may be on top or in the spaces between the main springs.

In the preferred form of structure shown, all of the cross-stabilizing members 18 intersect the longitudinal members at one side of the middle of all of the longitudinal members 14 and 16 as viewed in a cross-section of the thickness of the longitudinal members in a plane at a right angle to the length as the longitudinal members as illustrated in FIG. 3. Preferably the cross-stabilizing strands 18 intersect the longitudinal strands at or near the top thereof so that all of the strands on one side of the platform will be approximately coplanar and present a relatively flat support surface which is positioned to face the cushioning material.

In the preferred structure, the support platform 10 is approximately the same length as the mattress and opposite ends of platform 10 are affixed in the mattress structure in any convenient manner as by conventional hog rings to the wire border 54 of the structure. Best results are achieved by making support platform 10 wider than the width of the main springs in the mattress structure so that about two inches of the support platform can be folded down over the edges of the outside row of springs on opposite sides and attached as by hog rings to the sides of the springs as illustrated in FIG. 3.

It will be understood that the preferred embodiments shown in the drawings were selected for the purpose of illustration and that it is intended to cover all changes and modifications of the preferred embodiments which do not depart from the spirit and scope of the invention.

What is claimed is:

1. A mattress comprising a plurality of spaced springs, a plastic support platform having a plurality of extruded unoriented plastic spaced longitudinal support members and a plurality of extruded unoriented plastic spaced longitudinal stabilizing members, at least one of said stabilizing members being in position in each space between said longitudinal support members, said stabilizing members being smaller than said support members, a plurality of extruded plastic spaced cross-stabilizing members that intersect said support and stabilizing members substantially at a right angle and are integrally joined at the crossings, said cross-stabilizing members being oriented and smaller than said longitudinal support members, said support platform being in position on top of said springs with said longitudinal support members extending along the length of the mattress in contact with a majority of said plurality of springs, said longitudinal members having a breaking load of at least about 35 pounds for a strip having one large longitudinal member and one small longitudinal stabilizing member and said cross-stabilizing members having a breaking load of at least about 75 pounds for a strip having twelve said cross-stabilizing members and cushioning material positioned on top of said plastic support platform.

2. The mattress of claim 1 in which the cross-stabilizing members are smaller than the longitudinal stabilizing members.

3. The mattress of claim 1 in which the plurality of spaced springs are arranged in substantially parallel rows running along the length of the mattress and in which the longitudinal support members are in contact with substantially all of the springs in the mattress.

4. The mattress of claim 3 in which the cross-stabilizing members extend beyond the edges of the outermost springs at each side across the width of the mattress and are affixed to the springs below the top face of the spring members and in which the longitudinal members extend approximately to the outermost edges of the spring members at opposite ends of the mattress along its length.

5. The mattress of claim 1 in which the plastic is polypropylene and in which the breaking load of the longitudinal members is between about 37 and 54 pounds for a strip having one large longitudinal member and one small longitudinal stabilizing member and the breaking load of the cross-stabilizing members is between about 80 to 110 pounds for a strip having twelve said cross-stabilizing members.

6. A mattress structure comprising:

(a) a plurality of spaced springs arranged in substantially parallel rows along the length of the mattress;

(b) an extruded polypropylene support platform positioned on top of the face of said springs;

(c) said support platform having a plurality of unoriented spaced longitudinal support members;

(d) said support platform having a plurality of unoriented spaced longitudinal stabilizing members which are smaller than said support members with at least one stabilizing member being positioned in the space between each adjacent support member;

(e) said longitudinal members being connected in the platform by a plurality of oriented spaced cross-stabilizing members which are smaller than said longitudinal stabilizing members and which intersect each of said longitudinal members at substantially a right angle and are integrally joined to said longitudinal members on one side above the center of said longitudinal members in a cross-section of the thickness of said longitudinal members taken in a plane at a right angle to the length of said longitudinal members;

(f) said longitudinal support members being in position to contact substantially all of said spring members;

(g) said longitudinal members having a breaking load of at least about 35 pounds for a strip having one large longitudinal member and one small longitudinal stabilizing member and said cross-stabilizing members having a breaking load of at least about 75 pounds for a strip having twelve said cross-stabilizing members; and (h) cushioning material positioned on top of said extruded polypropylene support platform.

7. A plastic support platform in a form adapted to be used on the top of the springs in a mattress structure, said platform comprising a first plurality of extruded spaced longitudinal support members having at least one smaller extruded longitudinal stabilizing member in the space between adjacent members of said first plurality of members and a plurality of spaced smaller extruded and oriented transverse cross-stabilizing members, said cross-stabilizing members being arranged in position to cross said longitudinal members substantially at a right angle with integral joints at the crossing and in which said longitudinal members have a breaking load of at least about 35 pounds for a strip having one large longitudinal member and one small longitudinal stabilizing member and said cross-stabilizing members having a breaking load of at least about 75 pounds for a strip having twelve said cross-stabilizing members.

8. The plastic support platform of claim 7 in which the distance between adjacent members of said first plurality of support members is about 4.0 inches from center to center and the distance from center to center of adjacent smaller longitudinal stabilizing members is about 4.0 inches and the distance between immediately adjacent large and small longitudinal members is about 2.0 inches and in which the distance between adjacent transverse cross-stabilizing members is about 0.25 inch.

9. The plastic support member of claim 7 in which the integral joints between the transverse cross-stabilizing members and longitudinal members are all positioned on one side of the middle of each of said longitudinal members in a cross-section of the thickness of said longitudinal members taken in a plane at a right angle to the length of said longitudinal members.

10. A polypropylene support platform for the springs in a cushioning structure which comprises:

(a) a plurality of spaced polypropylene unoriented extruded support members having at least one smaller polypropylene unoriented extruded stabilizing member in the space between adjacent support members;

(b) a plurality of spaced polypropylene oriented transverse cross-stabilizing members that intersect the longitudinal members substantially at a right angle in an integral joint positioned at one side of the middle of each of said longitudinal members in a cross-section of the thickness of said longitudinal members taken in a plane at a right angle to the length of said longitudinal members;

(c) said transverse cross-stabilizing members being smaller than said smaller longitudinal stabilizing members; and (d) said longitudinal members having a breaking load of at least about 35 pounds for a strip having one large longitudinal member and one small longitudinal stabilizing member and said cross-stabilizing members having a breaking load of at least about 75 pounds for a strip having twelve said cross-stabilizing members.

11. A mattress comprising spring members that present an open face with relatively large open spaces and a plurality of wire spring elements therein, cushioning material on at least one side of the open face of said spring members and a plastic support platform interposed between said cushioning material and the open face of said spring members, said plastic support platform having a plurality of spaced longitudinal support members extending along the length of said mattress structure in position to contact a majority of said wire spring elements and a plurality of smaller longitudinal stabilizing members at least one being positioned in the space between adjacent support members, said longitudinal members being secured in the platform by a plurality of spaced oriented plastic cross-stabilizing members which cross the longitudinal members substantially at a right angle and are integrally joined to said longitudinal members at the crossings and in which said longitudinal members have a breaking load of at least about 35 pounds for a strip of three inches in width and said cross stabilizing members have a breaking load of at least about 75 pounds for a strip of three inches in width.

* * * * *

UNITED STATES PATENT AND TRADEMARK OFFICE

CERTIFICATE OF CORRECTION

PATENT NO. : 4,432,109

DATED : February 21, 1984

INVENTOR(S) : Paul J. Huspeni

It is certified that error appears in the above-identified patent and that said Letters Patent are hereby corrected as shown below:

Column 2, line 2, change "of" (first instance) to --to--.

Column 8, line 43, change "crossing" to --crossings--.

Signed and Sealed this

*Twenty-sixth* Day of *February 1985*

[SEAL]

*Attest:*

DONALD J. QUIGG

*Attesting Officer*

*Acting Commissioner of Patents and Trademarks*